US005392492A

United States Patent [19]

Fassauer

[11] Patent Number: 5,392,492

[45] Date of Patent: Feb. 28, 1995

[54] AIR-FLOATED APPARATUS

[76] Inventor: Arthur L. Fassauer, 420 Foster La., Canyon, Tex. 79015

[21] Appl. No.: 964,562

[22] Filed: Oct. 21, 1992

Related U.S. Application Data

[63] Continuation of Ser. No. 564,197, Aug. 8, 1990, abandoned.

[51] Int. Cl.[6] ..... A47L 9/00

[52] U.S. Cl. ..... 15/327.3; 15/346; 15/385; 180/116; 180/129

[58] Field of Search ..... 15/327.3, 340.1, 345, 15/346, 385; 180/116, 122, 125, 126, 129, 130

[56] References Cited

U.S. PATENT DOCUMENTS

| | | | |
|---|---|---|---|
| 3,170,276 | 2/1965 | Hall | 180/129 X |
| 3,186,151 | 6/1965 | Hansom | 180/129 X |
| 3,283,355 | 11/1966 | Jepson | 180/116 X |
| 3,423,912 | 1/1969 | Heth | 180/116 X |
| 4,137,988 | 2/1979 | Croix-Marie | 180/130 |
| 4,571,849 | 2/1986 | Gardner et al. | 15/345 X |

FOREIGN PATENT DOCUMENTS

| | | | |
|---|---|---|---|
| 2945176 | 5/1981 | Germany | 15/327.3 |
| 3442228 | 5/1986 | Germany | 15/340.1 |
| 1020123 | 5/1983 | U.S.S.R. | 15/327.3 |

*Primary Examiner*—Chris K. Moore

*Attorney, Agent, or Firm*—Ross, Howison, Clapp & Korn

[57] ABSTRACT

The present invention describes an air-floated vacuum cleaner comprising a housing having an air inlet opening, an open bottom and an inner wall, an impeller for pressurizing air within the housing to float the housing above a support surface, and a novel vacuum module/agitator located below the impeller. The vacuum module/agitator is rotatable with the impeller for agitating dust and debris on the support surface and for simultaneously suctioning the dust and debris upwards for lateral displacement against the inner wall. The dust and debris is then centrifuged to a duct communicating with the inner wall. The air-floated vacuum cleaner further includes a flotation plate module for entrapping and sealing within the housing pressurized air generated by the impeller.

17 Claims, 3 Drawing Sheets

AIR-FLOATED APPARATUS

This application is a continuation of application Ser. No. 07/564,197, filed Aug. 8, 1990, and now abandoned.

TECHNICAL FIELD

The present invention relates generally to cleaning apparatus, such as a vacuum cleaner, and in particular to an air-floated apparatus that floats on an air cushion during operation.

BACKGROUND OF THE INVENTION

Apparatus for cleaning dust and debris from carpets and floors are well-known in the prior art. One such apparatus, commonly referred to as a carpet sweeper, includes a rotating member disposed beneath a head of the carpet sweeper for contacting the surface to be cleaned. The rotating member sweeps dirt and debris into a dirt collection receptacle. The rotary action of the rotating member is achieved by manually pushing the carpet sweeper across the carpet or floor. It is also known to provide electrically-powered vacuum cleaners that rely on vacuum suction to remove dirt and debris from the surface to be cleaned. Such cleaners conventionally include a rotating brush disposed beneath the vacuum cleaner head for stirring up dust and other debris and introducing the dust and debris into the vacuum suction.

Prior art sweepers and vacuum cleaners are limited to simple fore and aft motions because wheels required to support the apparatus effectively prevent lateral movement. Further, these devices have practical limitations because the cleaning area is limited to a relatively narrow area at the front of the apparatus. While there have been some improvements in vacuum cleaner technology, such as mechanisms to self-propel the apparatus, it would still be desirable to provide an improved vacuum cleaner apparatus that overcomes these and other problems associated with the prior art.

BRIEF SUMMARY OF THE INVENTION

It is an object of the present invention to provide a vacuum cleaner that floats on an air cushion during operation.

It is yet another object of the present invention to provide an air-floated vacuum cleaner apparatus that can be moved in any direction.

It is still another object of the invention to describe an air-floated vacuum cleaner that uses a single impeller and thus does not require separate and distinct pressure and vacuum chambers to float the housing and suction dust and debris.

It is still a further object of the invention to describe an air-floated vacuum cleaner that is simple to construct, has few moving parts and which is easy to maintain.

It is another object of the invention to provide an air-floated vacuum cleaner that includes a manual or automatic adjustment mechanism for sealing and entrapping a volume of pressurized air within the housing of the apparatus to thus enhance the flotation thereof.

It is still another object of the invention to provide an air-floated vacuum cleaner that includes a vacuum-/agitator means for suctioning dust and debris upwards for lateral displacement and centrifuging to a discharge port of the cleaner.

It is yet another object of the invention to provide an air-floated vacuum cleaner having a novel snap-on bristle or fine module that enhances the stirring up of dust and debris during the vacuum operation.

These and other objects of the invention are provided in an air-floated vacuum cleaner comprising a housing having an air inlet opening, an open bottom, and an inner wall, an impeller for pressurizing air within the housing to float the housing above a support surface, and a novel vacuum module/agitator located below the impeller. The vacuum module/agitator is rotatable with the impeller for agitating dust and debris on the support surface and for simultaneously suctioning the dust and debris upwards where it is then laterally thrown against the inner wall and centrifuged to a discharge port. A chamber communicates with the discharge port for collecting the dust and debris exhausted therefrom.

In the preferred embodiment, the vacuum/agitator comprises a base having a periphery, at least one extension positioned on the periphery of said base, and a member extending upwardly and angularly from the extension such that as the base is rotated with the impeller means a vacuum is generated behind the member. The agitation function is effected by a snap-on module removably secured to the extension and including a plurality of tines or bristles each of which extends downwardly from the extension and contacts the support surface. Preferably, the base is substantially circular in shape and includes a plurality of radially-disposed extensions, each of which support a member and a snap-on bristle or fine module.

According to another feature of the invention, the air-floated vacuum cleaner also includes a flotation plate module for entrapping and sealing within the housing pressurized air generated by the impeller. Preferably, the flotation plate module comprises a substantially H-shaped support having an upper channel and a lower channel, the upper channel for receiving a bottom edge of the housing. A flotation plate member is integrally formed with or attached to the support and extends inwardly into the housing to direct the pressurized air. An air entrapment boss member is supported for vertical movement within the lower channel and includes a boss for trapping-within the housing pressurized air generated by the impeller. The boss member is preferably spring-biased for automatic adjustment of a vertical position of the boss relative to the support surface. Alternatively, the boss can be manually positioned.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

Figure 1:
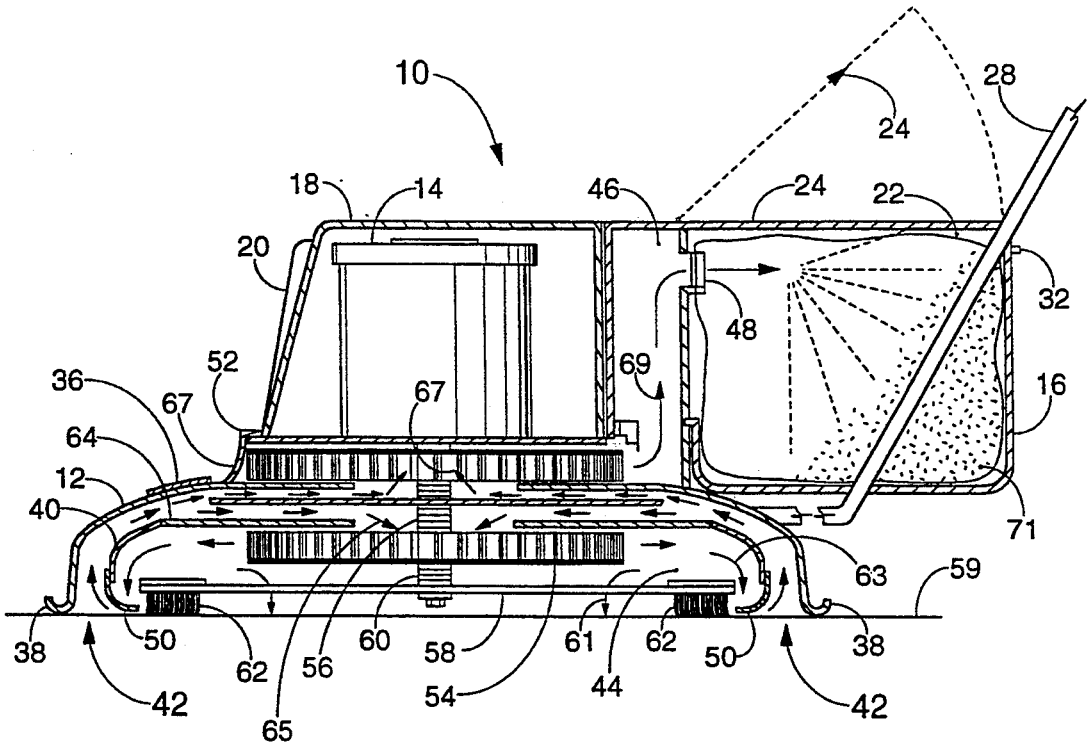
FIG. 1 is a sectional view of an air-floated vacuum cleaner.

One type of air-floated vacuum cleaner is shown in FIG. 1 and described in copending application Ser. No. 07/528,718, filed May 24, 1990, and incorporated herein by reference. As shown in FIG. 1, air-floated vacuum cleaner 10 is comprised of an exterior deck housing 12, a power source such as an electric motor 14, and an exterior molded receptacle 16 for collecting dust and debris discharged from housing 12. Electric motor 14 is operatively mounted on top of housing 12 in a conventional manner. Motor 14 is received within a casing 18, which is also mounted on top of housing 12. Casing 18 includes a louvre to provide ventilation for motor 14.

Receptacle 16 is attached to a back portion of casing 18 and is adapted for receiving a disposable bag 22 for collecting dust and debris picked up by vacuum cleaner 10. Receptacle 16 further includes a hinged lid 24, which can be opened to obtain access to bag 22. A handle 26, having two depending arms 28, is pivotally attached to housing 12 by means of brackets (not shown). A hinge mechanism (not shown) maintains lid 24 in closed position and is released by means of a conventional push button release mechanism 32, which is disposed on a back surface of receptacle 16. Handle 26 preferably includes a push button ON/OFF switch 34 for controlling the operation of vacuum cleaner 10.

Housing 12 has a plurality of air inlet openings 36. The bottom part of housing 12 is defined by an upturned peripheral lip member 38. Housing 12 is preferably an endless housing and in one embodiment has a substantially rectangular shape with rounded corners. In an alternate embodiment (not shown), housing 12 can be configured with a substantially circular shape.

An endless shroud 40 is disposed inside of housing 12 to define a first air chamber 42 between housing 12 and shroud 40 and a second air chamber 44 inside of shroud 40. First air chamber 42 substantially completely surrounds shroud 40 and communicates with a passageway 46 leading to receptacle 16 via open mouth 48 of receptacle 16. First chamber 42 defines a substantially ring-shaped chamber through which dust and debris sucked up by vacuum cleaner 10 are exhausted into receptacle 16, as will be described in greater detail hereinafter.

Shroud 40 terminates at a bottom part thereof in a relatively flat shelf or plate 50, which projects into second chamber 44. Plate 50 projects into second chamber 44 from around substantially the entire bottom part of shroud 40, such that plate 50 defines a substantially 360° shelf around the bottom part of shroud 40. A first air impeller 52 is located within first chamber 42 for exhausting air and the dust and debris from first chamber 42 into passageway 46. A second air impeller 54 is located within second chamber 44 for pressurizing the air introduced into second chamber 44 via inlet opening 36. First and second air impellers 52 and 54 are mounted for co-rotation with shaft 56 of motor 14. A flexible blade member 58 is also mounted for co-rotation with shaft 56, below first and second air impellers 52 and 54. Spacers 60 are positioned between second air impeller 54 and blade member 58 to adjust the position of blade member 58 vertically. Blade member 58 has a plurality of flexible bristles 62 at each end thereof for contacting a surface 59, such as a floor or carpet, beneath shroud 40 for agitating dust and debris on surface 59 when blade member 58 is rotated during the operation of vacuum cleaner 10. The arrows indicate the flow of air within housing 12 and shroud 40.

Air is introduced through inlet openings 36 directly into second chamber 44. A relatively flat platform 64 having a central opening channels the air to the suction side of second air impeller 54, as indicated at 65. Second air impeller 54 discharges the air under pressure by centrifugal force outwardly toward shroud 40, as indicated by arrows 63. The air will follow the path of least resistance downwardly along shroud 40 until the air is acted upon by plate 50, which directs the air flow inwardly within second chamber 44. As the air flows downwardly and inwardly within second chamber 44, the air will contact the surface beneath shroud 40 to provide a ground effect, as indicated by arrows 61 whereby the entire housing 12 and shroud 40 are lifted slightly above support surface 59. At least some of the air will escape from second chamber 44 beneath plate 50 and the escaping air acting on an undersurface of plate 50 will further enhance the lifting action imparted to housing 12 and shroud 40.

The rotary action of blade member 58 will stir up dust and debris from support surface 59 along the path or air escaping from second chamber 44, such that the dust and debris will be carried by the escaping air from second chamber 44 (which functions as a pressure chamber) into first chamber 42 (which functions as a vacuum chamber). The escaping air will also "aerate" support surface 59 to further enhance the removal of dust and debris therefrom. Although some of the air will escape from housing 12 underneath lip member 38, the suction action created by the rotation of first air impeller 52 will provide a path of least resistance for the escaping air within first chamber 42. First air impeller 52 sucks air and dust and debris upwardly through first chamber 42, as indicated at 67, and discharges the air and dust and debris under pressure into passageway 46, as indicated at 69, and then through open mouth 48 into receptacle 16, where the dust and debris are collected, as indicated at 71. One skilled in the art will appreciate that a relatively constant air flow is established within housing 12 and shroud 40 and that the same air which is used to pressurize second chamber 44 and lift housing 12 and shroud 40 above support surface 59 is also used as vacuum air to suck dust and debris into receptacle 16.

The flexibility of blade member 58 allows bristles 62 to follow the contours of support surface 59 and also provides a self-adjusting feature while vacuum cleaner 10 is in operation. The relatively flat plate 50 not only enhances the lifting force imparted to housing 12 and shroud 40, but also enhances the stability and handling characteristics of vacuum cleaner 10 by substantially preventing vacuum cleaner 10 from wobbling and meandering during operation. Plate 50 also functions as a seal to capture air within second chamber 44 and inhibit the escape of air from beneath lip member 38.

As described in copending application Ser. No. 07/528,718, air-floated vacuum cleaner of FIG. 1 has many advantages over prior air wheel-supported vacuum cleaners. By eliminating the support wheels, the air-floated vacuum cleaner can be moved in any direction or along any arc between 0° and 360° and is not limited to the fore and aft movements of conventional vacuum cleaners. Furthermore, the vacuuming action takes place around the entire perimeter of the vacuum cleaner housing and is not limited to a relatively narrow area at the front of the vacuum cleaner housing, as in conventional cleaners.

While the vacuum cleaner apparatus of FIG. 1 provides significant advantages over the prior art, it has now been found that similar advantageous results can be achieved using a simpler construction that relies on a single impeller rather than the first and second air impellers 52 and 54 of the apparatus 10. The resulting apparatus is less expensive to manufacture, has fewer moving parts and is easier to maintain, yet still provides all of the advantages of the air-floated apparatus 10 of FIG. 1. A side view of the single-impeller air-floated vacuum cleaner apparatus 70, partially cutaway, is shown in FIG. 2.

Figure 2:
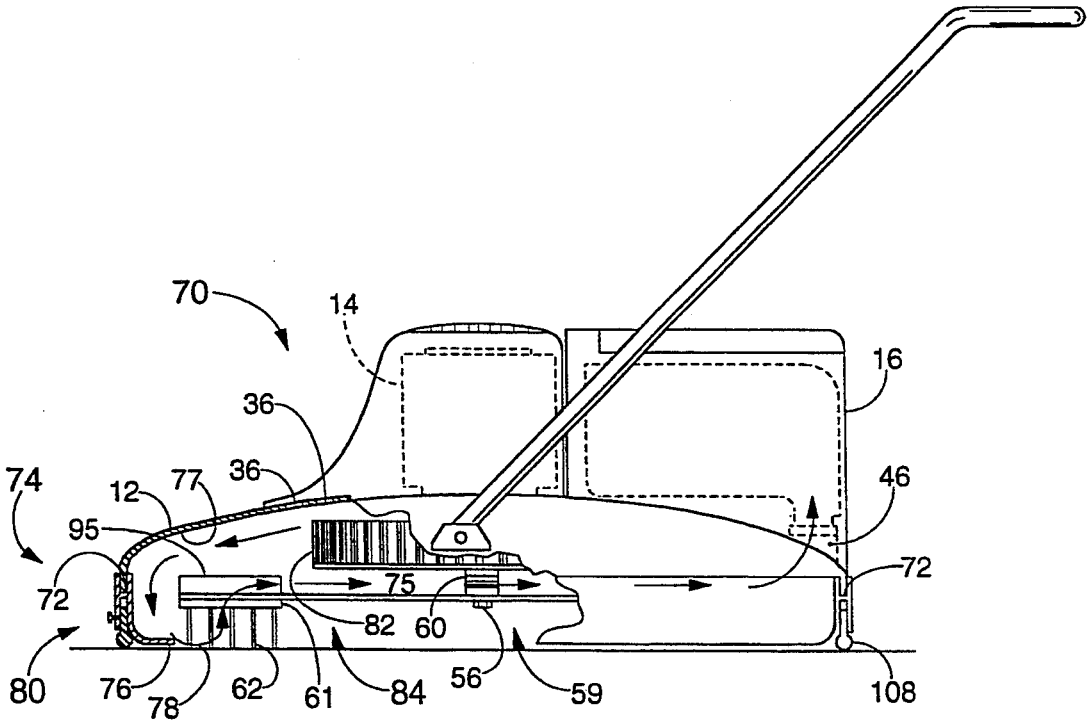
FIG. 2 is a side view, partially cutaway, of a single-impeller, air-floated vacuum cleaner apparatus in accordance with the present invention.

Air-floated vacuum cleaner apparatus 70 includes a housing 12 having a plurality of air inlet openings 36, two of which are shown in FIG. 2. The housing 12 is preferably an endless housing and in one embodiment has a substantially rectangular shape with rounded corners. Alternatively, housing 12 can be configured in a substantially circular or rectangular shape. Housing 12 includes a continuous bottom edge 72.

According to a preferred embodiment of the invention, an endless flotation plate module 74 is removably secured to the bottom edge 72 of the housing 12. The flotation plate module, which will be described in more detail below with respect to FIG. 5, includes an integral endless flotation plate member 76 that projects inwardly from around substantially the entire bottom part of the module 74. Although not shown in detail, flotation plate member 76 can alternatively be attached to the flotation plate module instead of being integrally formed therewith. As will be described, plate member 76 directs at least some air flowing downwardly along inner wall surface 77 of housing substantially laterally, as shown by the inwardly directed arrows 78. The flotation plate module also includes an endless air entrapment boss mechanism 80 that substantially reduces air leakage from the apparatus as will be described.

The vacuum cleaner 10 includes a single air impeller 82 for pressurizing the air introduced into the housing via inlet openings 36. Air impeller 82 is mounted for rotation with shaft 56 of motor 14. A flexible vacuum module 84 is also mounted below air impeller 82 for co-rotation with shaft 56 and thus the impeller. The vacuum module advantageously includes means for supporting a plurality of flexible snap-on modules 61 having tines (or bristles) 62 for contacting surface 59, such as a floor or carpet, beneath the housing 12 for agitating dust and debris on surface 59 when the vacuum module 84 is rotated during the operation of the vacuum cleaner. Spacers 60 are positioned between the vacuum module 84 and the air impeller 82 to vertically adjust the position of vacuum module and thus the tines 62.

Figure 3:
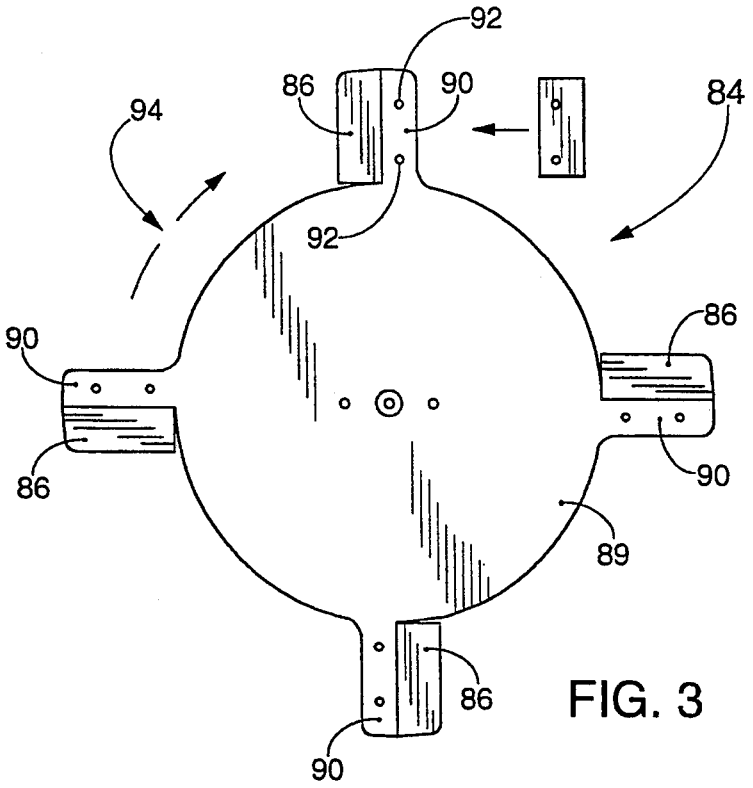
FIG. 3 is a plan view of the vacuum module assembly of the air-floated vacuum cleaner apparatus of FIG. 2 according to the teachings of this invention.

Referring now simultaneously to FIGS. 2 and 3, the structure and operation of the vacuum module 84 can now be described in detail. According to the present invention, the novel vacuum module 84 obviates use of distinct air impellers for pressurizing the housing to float the vacuum cleaner and for creating a vacuum to draw dust and debris into the cleaner. In particular, the vacuum cleaner 10 of FIG. 2 uses only a single air impeller 82 which functions to pressurize the housing and thus float the vacuum cleaner above the surface 59. To create the vacuum, the vacuum module includes a plurality of members 86, each extending in an upward angular manner. Preferably, but not by way of limitation, the vacuum module 84 comprised a substantially circular base portion 89 as shown in FIG. 3 which includes a plurality of extensions 90 equally positioned about the circumference of the base portion 89. Each member 86 is secured to a respective one of the extensions 90 by suitable fasteners 92. Alternatively, each member 86 is integrally formed with its respective extension 90 or the base portion itself. Also, each member 86 can be extended downward from the bottom side of its respective extension 90 at a substantially 90° angle to generate the vacuum.

In operation, as the vacuum module 84 rotates in the direction of the arrow 94 as shown in FIG. 3, a vacuum is effectively generated behind each of the upwardly-extending members 86 due to the movement of air over the top surface thereof. Accordingly, when pressurized air generated by the air impeller 82 contacts the surface 59 beneath the housing 12 to provide a ground effect, the entire housing 12 is lifted slightly above the surface 59. The rotary action of the tines 62 stir up dust and debris from surface 59 and this dust and debris is sucked upwards into the area directly above the vacuum module 84 by the vacuum generated behind each member 86 as the module 84 is rotated.

Therefore, according to the present invention, the vacuum module essentially has a dual vacuum and agitation function. The vacuum module is located below the air impeller. The vacuum module is then rotatable with the impeller for using the bristles or tines to agitate dust and debris on the support surface 59 and for using the members 86 to effect suctioning of the dust and debris upwards. Upon passing over the surface of the vacuum module, the dust and debris is thrown outwards or "centrifuged" against the inner wall surface 77 of the housing 12 where it is then delivered to the discharge port. This operation advantageously obviates use of two distinct and separate impellers and chambers as described above with respect to FIG. 1.

Figure 4:
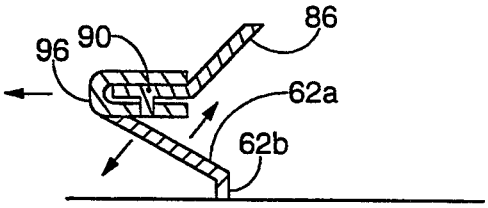
FIG. 4 is a detailed sectional view of one of the bristles supported on the vacuum module assembly of FIG. 3.

Referring to FIG. 4, a sectional view is shown of the preferred construction of each of the snap-on modules 61. FIG. 4 also discloses the upward angular member 86. As shown in this drawing, preferably each module includes a substantially u-shaped snap-on clip 96 which receives one of the extensions 90 of the base portion 89. As referenced above, the snap-on module includes a plurality of tines 62 (or, alternatively, bristles), one of which is shown in FIG. 4. Each tine comprises an angled first portion **62*a* and a vertically-extending second portion 62*b* integrally formed therewith or attached thereto. The second portion 62*b* contacts the surface 59 and stirs up debris and dust. The first portion 62*a* advantageously biases the second portion against the surface 59**. The resulting springlike agitation increases the stirring action.

Figure 5:
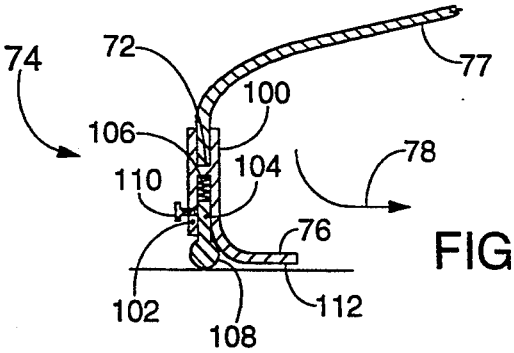
FIG. 5 is a detailed sectional view of the flotation plate module of the air-floated vacuum cleaner apparatus of the present invention.

Referring now to FIG. 5, a detailed sectional view is shown of a portion of the flotation plate module 74 of the present invention. As described above, the flotation plate module is removably secured to the bottom edge 72 of the housing 12 and includes the plate member 76 that projects inwardly from around the entire bottom part of the module 74. As described, plate member 76 directs the air flowing downwardly along inner surface 77 of housing substantially laterally, as shown by the inwardly directed arrow 78. The flotation plate module 74 is substantially H-shaped and includes an upper channel 100 for receiving the bottom edge 72 of the housing 12. Flotation plate module 74 also includes a lower channel 102 for supporting air entrapment boss mechanism 80 that substantially reduces air leakage from the apparatus. In particular, the air entrapment boss mechanism 80 includes a member 104 supported for vertical movement in the lower channel 102 against the bias of a spring 106. A substantially circular boss 108 is attached to the distal or bottom end of the member 104 or integrally formed therewith. Alternatively, the spring 106 can be omitted and the height of the boss 108 relative to the surface 59 is adjusted by threaded pin 110. Preferably, four (4) such pins 110 are placed about the circumference of the flotation module 74.

In operation, the air entrapment boss 108 is free-floating (by virtue of spring 106) or is fixed and set at a desired height by pins 110 to effectively seal the housing 12 and substantially prevent the pressurized air from escaping outwards from under the housing. This construction insures that the pressurized air generated by the air impeller 82 does not escape from the housing, thus promoting a constant sandwich of air between a bottom 112 of the-plate member 76 and the surface 59. This sandwich of air effectively provides a secondary lifting action which facilitates the flotation of the housing. In particular, any pressurized air that escapes under the edge of the plate member 76 is trapped between the bottom 112 of the member and the air entrapment boss 108 and thus creates added lift against the bottom 112. The boss 108 is therefore manually or automatically adjusted so that the vacuum cleaner is useful for differing heights of carpet piles.

The air entrapment mechanism shown is FIG. 5 is also desirable for use with other types of air-floated apparatus such as an air-floated lawn mower or the like. Thus the teachings of the invention described above with respect to FIG. 5 are considered applicable for all types of air-floated apparatus in which an impeller is used to generate pressurized air to float a housing above a support surface.

The vacuum cleaner 10 may include appropriate speed control means and a tachometer (not shown) for dynamically varying and indicating the speed and thus the RPM of the electric motor 14. Such variations produce corresponding increases or decreases in the air pressure created by the air impeller 82. However, because of the automatic adjustment provided by the spring-biased boss 108, motor speed and thus air pressure variations are automatically compensated such that consistent operation is maintained. Thus the vacuum cleaner can be used on different types of carpets or different heights of carpeting made from the same material.

Figure 6:
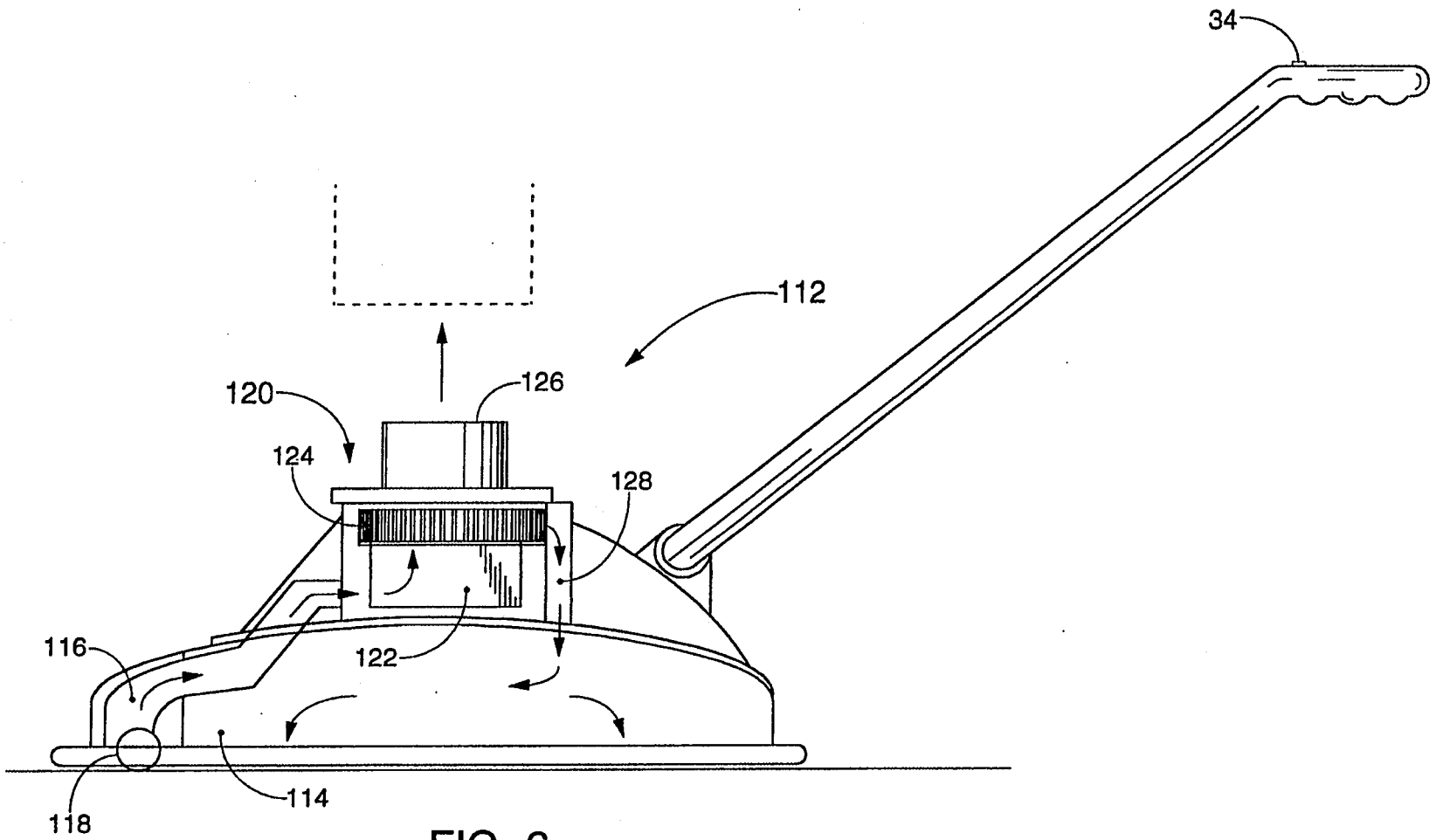
FIG. 6 is a sectional view showing an alternate embodiment of the invention embodied in a conventional canister-type vacuum cleaner.

Referring now to FIG. 6, the principles of the present invention are incorporated into a prior-art canister-type vacuum cleaner 112 having its wheel mechanism removed from housing 114. At the front of the housing 114 is a chamber 116 in which an agitator brush 118 is mounted. The chamber 116 communicates with the canister assembly 120 comprising filter 122, impeller 124 and motor 126. Actuation of the motor 126 causes impeller 124 to rotate, creating vacuum suction 116 chamber 116. Dust and debris is stirred up by brush 118 and sucked into the chamber 116 and drawn into the filter 122. In the prior art, the filtered air is simply vented to the atmosphere. According to this embodiment, however, the clean filtered air is returned through a duct 128 back into the housing 114. As noted above, the wheel mechanism normally present in the housing is removed. The clean filtered air is pressurized and thus serves to float the housing and provide mobility for the vacuum cleaner. Although not shown in detail, the housing 112 preferably includes flotation plate module or other means to trap pressurized air within the housing.

It should be appreciated by those skilled in the art that the specific embodiments disclosed above may be readily utilized as a basis for modifying or designing other structures for carrying out the same purposes of the present invention. It should also be realized by those skilled in the art that such equivalent constructions do not depart from the spirit and scope of the invention as set forth in the appended claims.

What is claimed is:

1. An air-floated vacuum cleaner for suctioning material from a support surface, comprising:
   - a housing having an air inlet opening, an open bottom, and an inner wall;
   - means for pressurizing the housing with air to float the housing above a support surface;
   - vacuum means rotatable within the housing for creating a relative vacuum to suction the material upwards from the support surface and for moving the material laterally outwardly against the inner wall as the vacuum means is rotated; and
   - means communicating with the inner wall of the housing for collecting the material moved laterally thereagainst.

2. The air-floated vacuum cleaner as described in claim 1 wherein the vacuum means comprises:
   - a base having a periphery;
   - at least one extension positioned on the periphery of said base; and
   - a member extending upwardly and angularly from the extension such that as the base is rotated within the housing, a relative vacuum or a suction is generated behind the member.

3. The air-floated vacuum cleaner as described in claim 2 wherein the vacuum means further includes an agitator means comprising:
   - a snap-on module secured to the extension and including a plurality of tines or bristles each of which extends downwardly from the extension and contacts the support surface.

4. The air-floated vacuum cleaner as described in claim 3 wherein each of the tines includes a first angled portion and a vertically-extending second portion biased against the support surface by the first angled portion.

5. The air-floated vacuum cleaner as described in claim 1 wherein the means for pressurizing comprises a rotatable impeller, and the vacuum means comprises:
   - a substantially circular base having a periphery rotatable coaxially with the impeller;

a plurality of extensions radially positioned about the periphery of said base; and a plurality of members, each member extending upwardly and angularly from one of the extensions such that as the impeller and the base are rotated, a relative vacuum is generated behind the members.

6. The air-floated vacuum cleaner as described in claim 5 wherein the vacuum means further includes agitator means comprising:

a snap-on module secured to each extension and including a plurality of tines each of which extends downwardly from the extension and contacts the support surface.

7. The air-floated vacuum cleaner as described in claim 6 wherein each of the tines includes a first angled portion and a vertically-extending second portion biased against the support surface by the first angled portion.

8. The air-floated vacuum cleaner as described in claim 1 further including means for entrapping within the housing pressurized air generated by the impeller means.

9. The air-floated vacuum cleaner as described in claim 8 wherein the entrapping means comprises:

support means having an upper channel and a lower channel, the upper channel for receiving a bottom edge of the housing;

a plate projecting from the lower channel into said housing for directing pressurized air inwardly; and an air entrapment boss member supported for vertical movement within the lower channel and including a boss for trapping within the housing pressurized air generated by the impeller means.

10. The air-floated vacuum cleaner as described in claim 9 wherein the air entrapment boss member is spring-biased for automatic adjustment of a vertical position of the boss relative to the support surface.

11. The air-floated vacuum cleaner as described in claim 9 wherein the entrapping means further includes a pin for manually adjusting a vertical position of the boss relative to the support surface.

12. An air-floated vacuum cleaner, comprising:

a housing having an air inlet opening, an open bottom, and an inner wall;

impeller means for pressurizing the housing with air to float the housing above a support surface; and vacuum means located below the impeller means, the vacuum means being rotatable with the impeller means for agitating material on the support surface and for suctioning the material upwards for lateral displacement against the inner wall as the vacuum means is rotated, the vacuum means comprising:

a base having a periphery;

at least one extension positioned on the periphery of said base;

a member extending upwardly and angularly from the extension such that as the base is rotated with the impeller means a vacuum is generated behind the member; and a snap-on module secured to the extension and including a plurality of tines each of which extends downwardly from the extension and contacts the support surface.

13. The air-floated vacuum cleaner as described in claim 12 further including means for entrapping within the housing pressurized air generated by the impeller means.

14. The air-floated vacuum cleaner as described in claim 13 wherein the entrapping means comprises:

support means having an upper channel and a lower channel, the upper channel for receiving a bottom edge of the housing;

a plate projecting from the lower channel into said housing for directing air inwardly; and an air entrapment boss member supported for vertical movement within the lower channel and including a boss for trapping within the housing pressurized air generated by the impeller means.

15. The air-floated vacuum cleaner as described in claim 14 wherein the air entrapment boss member is spring-biased for automatic adjustment of a vertical position of the boss relative to the support surface.

16. The air-floated vacuum cleaner as described in claim 14 wherein the entrapping means further includes a pin for manually adjusting a vertical position of the boss relative to the support surface.

17. An air-floated apparatus, comprising:

a housing having an air inlet opening, an open bottom and an inner wall;

impeller means for pressurizing the housing with air to float the housing above a support surface; and means for entrapping within the housing pressurized air generated by the impeller means, the means for entrapping comprises:

support means having an upper channel and a lower channel, the upper channel for receiving a bottom edge of the housing;

a plate projecting from the lower channel into said housing for directing air inwardly;

an air entrapment boss member supported for vertical movement within the lower channel and including a boss for trapping the pressurized air generated by the impeller means; and means for adjusting a vertical position of the boss relative to the support surface.

* * * * *